US006484549B1

(12) United States Patent
Liu

(10) Patent No.: US 6,484,549 B1
(45) Date of Patent: Nov. 26, 2002

(54) DIE BLOCK ASSEMBLY

(75) Inventor: Yao-Tser Liu, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/717,744

(22) Filed: Nov. 21, 2000

(30) Foreign Application Priority Data

Aug. 18, 2000 (TW) ..... 89214395 U

(51) Int. Cl.[7] ..... B21J 13/03
(52) U.S. Cl. ..... 72/344; 72/452.9
(58) Field of Search ..... 72/344, 395, 402, 72/427, 452.9, 461

(56) References Cited

U.S. PATENT DOCUMENTS 1,977,163 A * 10/1934 Wilcox ..... 72/427
2,357,204 A * 8/1944 Joyner ..... 72/395
3,693,399 A * 9/1972 Chirco ..... 72/402
6,189,361 B1 * 2/2001 Seki et al. ..... 72/395

* cited by examiner

*Primary Examiner*—Lowell A. Larson
(74) *Attorney, Agent, or Firm*—Wei Te Chung

(57) ABSTRACT

A die block assembly includes a sliding block (50) and a die plate (70). The sliding block has a base (53) from which a pair of slanted rails (58) extends. A protrusion (61) with a vertical outer wall (62) extends from an end of the base, between the rails. The die plate defines an opening (72) for movably receiving the block. A pair of slanted guiding grooves (74) is defined in the plate, for slidably receiving the rails of the sliding block. A recess (76) bounded by a vertical inner wall (78) is defined in the plate, for movably receiving the protrusion of the block. Upon assembly, in a first position, a clearance exists between the outer wall of the block and the inner wall of the recess. In a second position, the outer wall abuts the inner wall. Thus movement of the block is limited to a predetermined range.

10 Claims, 4 Drawing Sheets

DIE BLOCK ASSEMBLY

BACKGROUND

1. Field of the Invention

The present invention relates to a die block assembly, and particularly to a die block assembly having a sliding block.

2. Related Art

A sliding block is one of the most important parts used in the die industry. A conventional punch of a die can only move vertically, not horizontally. To enable dies to be fully adjustable, a variety of movable sliding blocks have been developed. A typical sliding block can be moved horizontally and vertically according to a pair of slanted rails formed on its sides. For convenient operation, the range of movement of the sliding block needs to be limited.

FIG. 6 shows a conventional die block assembly. A protrusion 32 is formed on a sliding block 30, for engaging with a groove 36 defined in a die plate 34. Upward movement of the sliding block 30 is limited when the protrusion 32 abuts a top face 38 of a groove 36 of the die plate 34. FIG. 7 shows another conventional die block assembly. A cutout 42 isdefined in an upper portion of a rear wall of a sliding block 40, and a stopper tab 48 is fixed on the die plate 44 by a screw 46. Upward movement of the sliding block 40 is limited when the stopper plate 48 abuts a bottom face of the cutout 42 of the sliding block 40.

However, manufacture and assembly of the above-mentioned die block assemblies is unduly complicated. Furthermore, components such as the protrusion 32 and the stopper tab 48 are prone to wear out after repeated use.

A die block assembly which overcomes the above problems is strongly desired.

SUMMARY OF THE INVENTION

Accordingly, an object of the present invention is to provide a die block assembly which is easily manufactured and assembled.

Another object of the present invention is to provide a die block assembly which is durable and reliable.

To achieve the above-mentioned objects, a die block assembly of the present invention comprises a sliding block and a die plate. The sliding block has a base from which a pair of opposite slanted rails extends. A protrusion with a vertical outer wall extends from one end of the base, between the rails. The die plate has an opening for movably receiving the sliding block therein. A pair of slanted guiding grooves is defined in the plate on respective opposite sides of the opening, for slidably receiving the rails of the sliding block therein. A recess bounded by a vertical inner wall is defined in the plate, for movably receiving the protrusion of the block therein. Upon assembly, in a first position, a clearance exists between the outer wall of the block and the inner wall of the recess. In a second position, the outer wall of the block abuts the inner wall of the recess. Thus movement of the block is limited to a predetermined range.

Other objects, advantages and novel features of the present invention will be apparent from the following detailed description of preferred embodiments of the present invention with reference to the attached drawings, in which:

DESCRIPTION OF THE PREFERRED EMBODIMENTS

Figure 1:
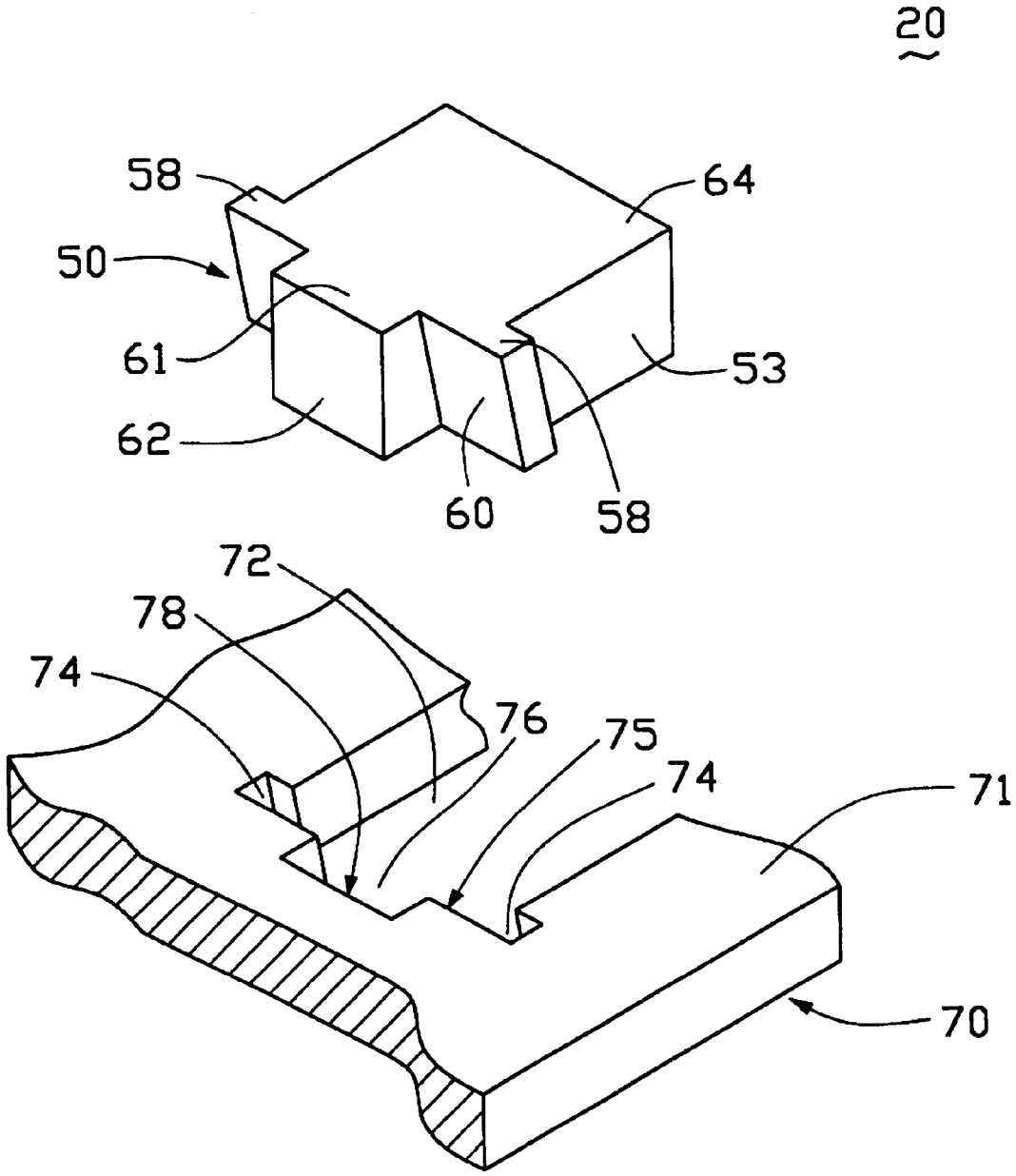
FIG. 1 is an exploded view of a preferred embodiment of a die block assembly in accordance with the present invention.

Referring to FIG. 1, a die block assembly 20 in accordance with the present invention comprises a sliding block 50 and a die plate 70.

The sliding block 50 has a generally box-shaped base 53 with a top face 64. A pair of slanted rails 58 extends from respective opposite lateral sides (not labeled) of the base 53 at an outer end (not labeled)thereof. Each rail 58 has an outer slanted wall 60. A first pitch angle is defined between the top face 64 of the base 53 and the slanted walls 60 of the rails 58, being slightly less than 90 degrees. A protrusion 61 extends from the outer end (not labeled) of the base 53. The protrusion 61 has a vertical outer wall 62.

The die plate 70 has a top face 71, and an opening 72 defined in the plate 70 for slidably receiving the sliding block 50. A pair of opposite slanted guiding grooves 74 is defined in the plate 70, corresponding to the slanted rails 58 of the block 50. The guiding grooves 74 are in communication with the opening 72. Inner slanted walls 75 form respective distal extremities of each guiding groove 74, and correspond to the slanted walls 60 of the block 50. A second pitch angle is defined between the top face 71 of the plate 70 and the inner slanted walls 75, being substantially the same as the first pitch angle. A recess 76 is defined in the plate 70, corresponding to the protrusion 61 of the block 50. The recess 76 is in communication with the opening 72. The recess 76 has a vertical inner wall 78, corresponding to the outer wall 62 of the block 50.

Figure 2:
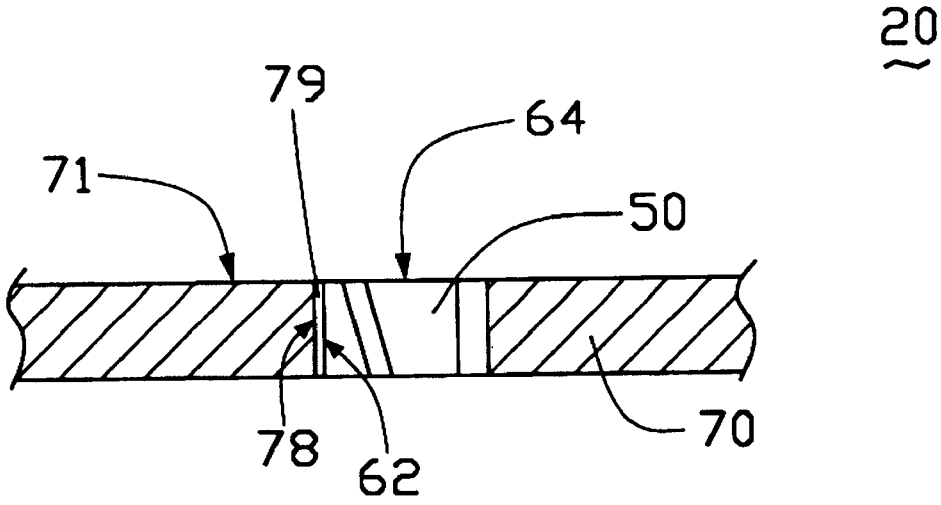
FIG. 2 is an assembled cross-section view of the die block assembly of FIG. 1, showing a sliding block of the assembly in a first position.

Referring to FIG. 2, in assembly, the block 50 is slid into the opening 72 of the plate 70, from the bottom of the plate 70. The rails 58 and the protrusion 61 of the sliding block 50 are respectively received in the grooves 74 and the recess 76 of the plate 70. The top surface 64 of the block 50 is coplanar with the top surface 71 of the plate 70. A clearance 79 is defined between the outer wall 62 of the block 50 and the inner wall 78 of the plate 70. At this stage, the block 50 is defined to be in a first position.

Figure 3:
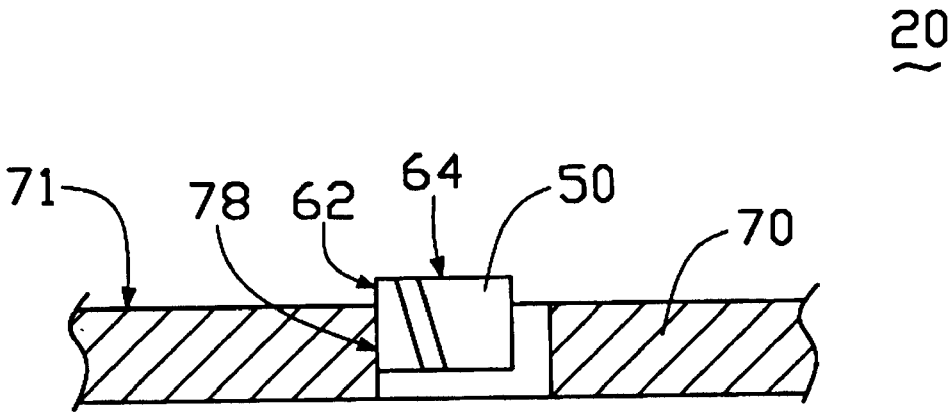
FIG. 3 is similar to FIG. 1, but showing the sliding block in a second position.

Referring to FIG. 3, in operation, the block 50 is moved upwardly by an ejection pad (not shown) located thereunder. The grooves 74 of the plate 70 restrict horizontal and vertical movement of the rails 58 of the block 50. Thus the block 50 moves along a single uniform path determined by the position of the grooves 74 of the plate 70. The ejection pad (not shown) continues to move the block 50 until the outer wall 62 of the block 50 abuts the inner wall 78 of the plate 70. At this stage, the block 50 cannot be moved upwardly any farther, and the block 50 is defined to be in a second position. Thus, movement of the block 50 is limited to a predetermined range.

Figure 4:
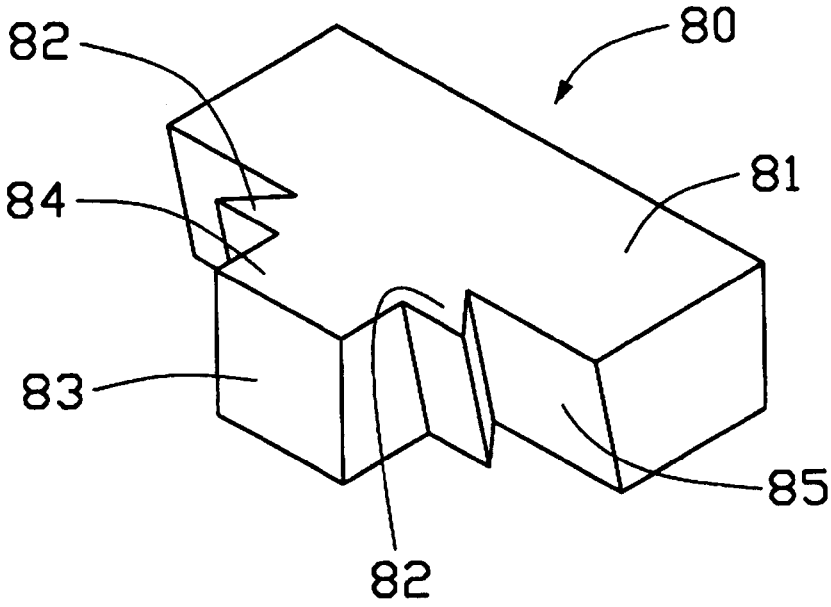
FIG. 4 is a perspective view of a sliding block in accordance with an alternative embodiment of the present invention.

FIG. 4 is a perspective view of a sliding block 80 in accordance with an alternative embodiment of the present invention. The sliding block 80 has a base 81. A pair of opposite slanted swallow-tailed rails 82 extends from a slanted wall 85 of the base 81. A protrusion 84 extends from the slanted wall 85, between the rails 82. The protrusion 84 has a vertical outer wall 83.

Figure 5:
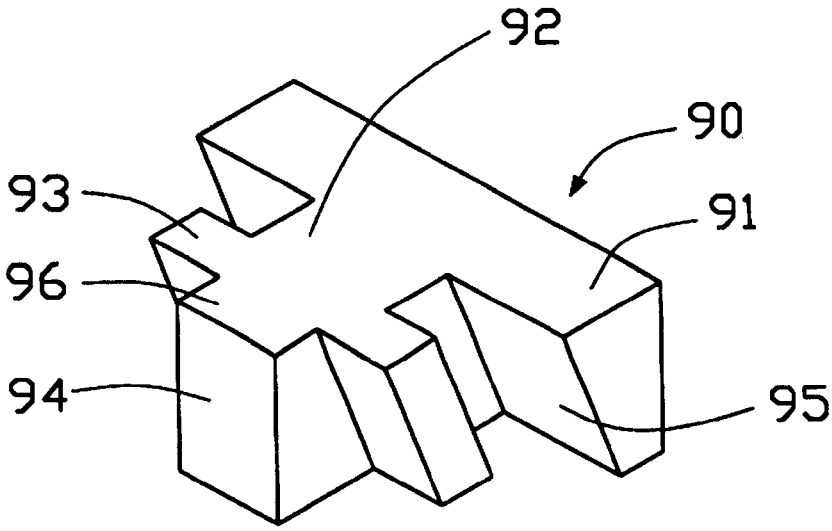
FIG. 5 is a perspective view of a sliding block in accordance with a further alternative embodiment of the present invention.
Figure 6:
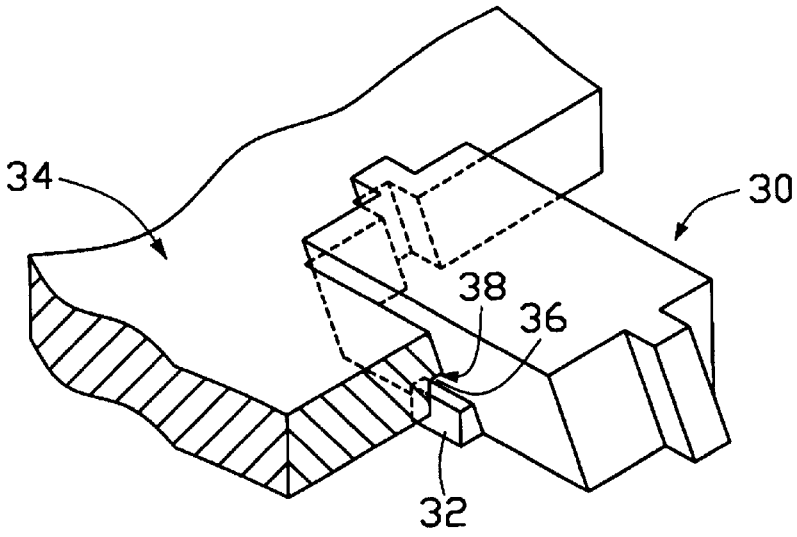
FIG. 6 (PRIOR ART)
FIG. 6 is an assembled view of a conventional die block assembly.
Figure 7:
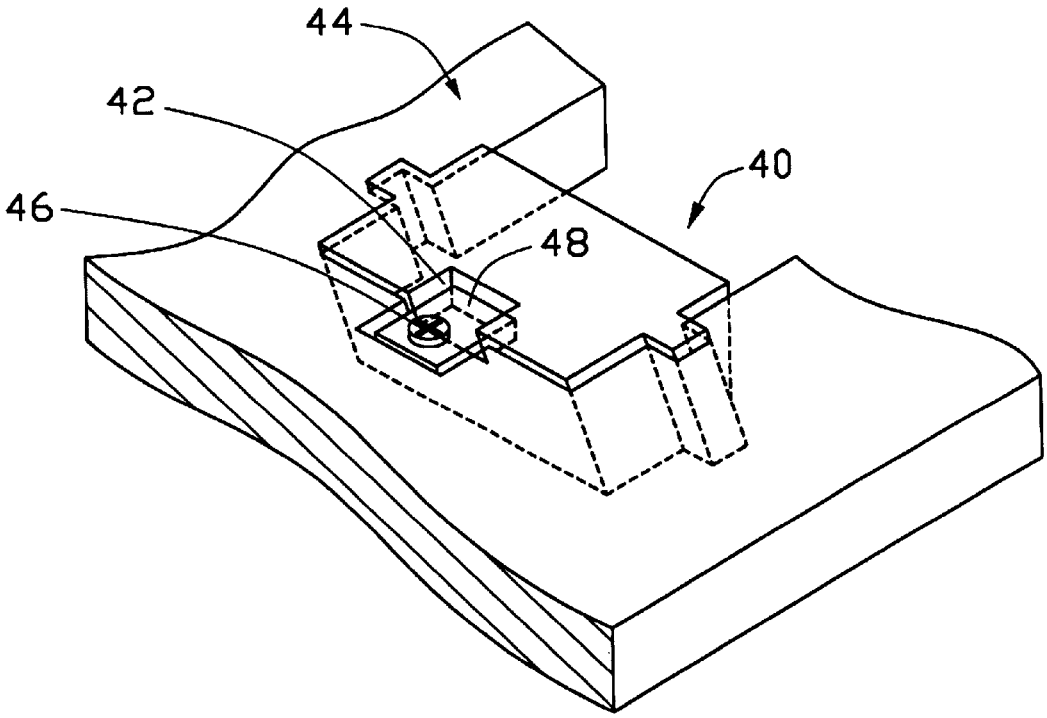
FIG. 7 (PRIOR ART)
FIG. 7 is an assembled view of another conventional die block assembly.

FIG. 5 is a perspective view of a sliding block 90 in accordance with a further alternative embodiment of the present invention. The sliding block 90 has a base 91. A connection portion 92 extends from a slanted wall 95 of the base 91. A pair of slanted rails 93 extends from respective opposite sides of the connection portion 92. A protrusion 96 extends from an outer end (not labeled) of the connection portion 92, between the rails 93. The protrusion 96 has a vertical outer wall 94.

The features of the invention is to provide the die plate with a sliding plane on which the sliding block moves, and an abutment plane on which the sliding block abuts when the sliding block moves along the sliding plane toward the abutment plane wherein the sliding plane and the abutment plane are not parallel to each other. Understandably, the sliding block is provided with means for compliantly moving along the sliding plane and with a wall parallel to the abutment plane for engagement therebetween.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A die block assembly comprising:

a die plate defining an opening, at least a slanted groove in communication with the opening, and at least a recess in communication with the opening and bounded by at least an inner wall; and a sliding block received in the opening of the die plate, the sliding block having at least an external slanted rail received in the at least slanted groove of the die plate, and at least a protrusion received in the at least a recess of the die plate, the protrusion having at least an outer wall; wherein when the sliding block is received in the die plate at a first position, the at least an outer wall of the protrusion does not contact the at least an inner wall of the recess, but when the sliding block is moved upwardly to a second position, the at least an outer wall abuts the at least an inner wall thereby preventing further upward movement of the sliding block.

2. The die block assembly as described in claim 1, wherein each inner wall of the die plate and each outer wall of the sliding block is vertical.

3. The die block assembly as described in claim 1, wherein the sliding block further comprises a base from which the at least a slanted rail and the at least a protrusion extend, and the base is slidably received in the opening of the die plate.

4. The die block assembly as described in claim 1, wherein each slanted rail of the sliding block is swallow-tailed.

5. The die block assembly as described in claim 3, wherein at least a connecting portion is formed between the base and the at least a slanted rail.

6. A die block assembly comprising:

a die plate defining a sliding plane and an abutment plane, said sliding plane and said abutment plane being of non-parallel relationship; and a sliding block including a guiding member extending from a top surface of the sliding block to a bottom surface of the sliding block for compliantly moving along said sliding plane, and a wall extending from said top surface to said bottom surface and being parallel to the abutment plane; wherein said wall abuts against the abutment plane when said sliding bock moves along the sliding plane toward said abutment plane.

7. The die block assembly as described in claim 6, wherein said abutment plane substantially fully extends through the die plate.

8. The die block assembly as described in claim 6, wherein said sliding plane is defined by at least one guiding slot, and said guiding member is defined by at least one rail protruding beyond a lateral side of the sliding block.

9. The die block assembly as described in claim 6, wherein said abutment plane is defined by an inner wall.

10. A die block assembly comprising:

a die plate defining an opening with a recess and two guiding grooves communicatively thereabouts, said recess substantially extending through the die plate; and a sliding block including a base, a pair of rails extending from opposite lateral sides of the base and a protrusion; wherein the sliding block is moveable within the opening by means of the rails receivably moving along the corresponding guiding grooves, while being stopped when the protrusion is fully received within the recess and abuts against an inner wall of the die plate around said recess.

* * * * *